US008251184B2

(12) United States Patent
De Jong

(10) Patent No.: US 8,251,184 B2
(45) Date of Patent: Aug. 28, 2012

(54) HYDRAULIC LOAD LIFTER WITH ENERGY RECOVERY SYSTEM

(75) Inventor: Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 428 days.

(21) Appl. No.: 12/559,880

(22) Filed: Sep. 15, 2009

(65) Prior Publication Data

US 2010/0066278 A1 Mar. 18, 2010

(51) Int. Cl.
*B66F 7/10* (2006.01)

(52) U.S. Cl. ..... 187/210; 187/290

(58) Field of Classification Search ..... 187/203, 187/209, 210, 223, 277, 285, 286, 290, 391–393
See application file for complete search history.

(56) References Cited

U.S. PATENT DOCUMENTS

| | | | | |
|---|---|---|---|---|
| 4,777,798 | A | 10/1988 | Jacobson et al. | |
| 5,540,554 | A * | 7/1996 | Masuzawa | 417/20 |
| 5,890,835 | A * | 4/1999 | Basta et al. | 405/3 |
| 5,911,408 | A | 6/1999 | Berends et al. | |
| 5,975,495 | A | 11/1999 | Berends et al. | |
| 6,189,432 | B1 * | 2/2001 | Colarelli et al. | 91/171 |
| 6,193,219 | B1 | 2/2001 | Belley et al. | |
| 6,315,079 | B1 | 11/2001 | Berends et al. | |
| 6,505,711 | B1 * | 1/2003 | Zurcher et al. | 187/285 |
| 6,505,815 | B1 | 1/2003 | Dellamore | |
| 6,634,461 | B1 | 10/2003 | Baker | |
| 6,763,916 | B2 * | 7/2004 | Green et al. | 187/277 |
| 6,817,449 | B2 | 11/2004 | Berends | |
| 7,014,012 | B2 * | 3/2006 | Baker | 187/247 |
| 7,219,770 | B2 * | 5/2007 | Baker | 187/247 |
| 7,500,816 | B2 | 3/2009 | Berends et al. | |
| 7,940,016 | B2 * | 5/2011 | Donnelly et al. | 318/139 |

FOREIGN PATENT DOCUMENTS

| | | | |
|---|---|---|---|
| DE | 44 02 653 | A1 | 8/1995 |
| DE | 197 09 474 | A1 | 9/1998 |
| EP | 263262 | A2 | 4/1988 |
| EP | 0 777 055 | A2 | 4/1997 |
| EP | 0 802 153 | A1 | 10/1997 |
| WO | 9219527 | A1 | 11/1992 |
| WO | 2007/126310 | A1 | 11/2007 |

OTHER PUBLICATIONS

Stertil B.V., Mobile Column Lifts ST 1072, Jan. 3, 1999, Stertil B.V., Kootstertille, The Netherlands, pp. 1-45.

* cited by examiner

*Primary Examiner* — Anthony Salata
(74) *Attorney, Agent, or Firm* — The Webb Law Firm

(57) ABSTRACT

Provided is a system, lifting column and method for the energy efficient lifting and lowering of a load, such as a vehicle. The system includes a lifting column having a frame with a movable carrier and a drive which acts on the carrier. The drive includes a power source for power supply to a motor, a pump in an ascent mode driven by the motor and in a decent mode driving the motor as a generator for energy-recovery, and motor control unit for control of the motor. The motor control unit is arranged such that the power supply of the motor is manipulated for speed control of the carrier in at least the ascent mode.

13 Claims, 4 Drawing Sheets

HYDRAULIC LOAD LIFTER WITH ENERGY RECOVERY SYSTEM

BACKGROUND OF THE INVENTION

1) Field of the Invention

The present invention relates to a system for energy-efficient lifting and lowering a load, such as a vehicle. In such system a number of lifting columns is being used.

2) Description of the Prior Art

Known systems for lifting and lowering a vehicle comprise a number of lifting columns. Each lifting column comprises a frame with a carrier that is connected to a drive, for moving the carrier upwards and downwards. In the ascent mode a hydraulic oil is pumped to a cylinder for lifting the carrier and therefore the vehicle. In the descent mode the carrier with the vehicle is lowered and hydraulic oil from the vehicle returns to the reservoir. In principal a closed system for the hydraulic oil is realized by using the reservoir. Lifting relatively heavy vehicles requires the use of a significant amount of energy. In addition, as the pressure on efficient operation in for example workshops using lifting columns is increasing, lifting columns are used more intensely as vehicles are put on lifting columns repeatingly, for example, when waiting for repair parts. As the number of lifting operations increase, also the amount of energy required for the lifting operations further increases.

SUMMARY OF THE INVENTION

The present invention has for its object to provide a system for energy-efficient lifting and lowering a load and minimizes the requirements on energy usage in these operations.

This objective is achieved with the system according to the invention, comprising:

- a lifting column comprising a frame with a movable carrier and a drive which acts on the carrier, wherein the drive comprises a power source for power supply to a motor,
- a pump in an ascent mode driven by the motor and in a decent mode driving the motor as a generator for energy-recovery; and
- motor control means for control of the motor, the motor control means arranged such that the power supply to the motor is manipulated for speed control of the carrier in at least the ascent mode.

In the ascent mode hydraulic oil is pumped into the cylinder of the lifting column for moving the carrier. This pump is driven by a motor. The required power is supplied by a power source. This can be an electrical power source. When lifting a load, such as a vehicle, this power supplied in the form of electrical energy is transferred to potential energy of mainly the vehicle and carrier. In the descent mode, the hydraulic oil of the cylinder is returned to the reservoir and the potential energy of the vehicle and carrier is removed by letting the hydraulic oil flow from the cylinder through the pump means. In the descent mode the pump means drive the motor. By driving the motor, this motor in fact operates as a generator, thereby generating energy. This means that potential energy is transferred into electrical energy. This generated electrical energy can be stored in batteries or fed back to the electricity grid. The motor control means control the moving speed of the carrier. The motor control means manipulates the power supply to the motor of the lifting column, such that this speed of the carrier can be controlled. The effect thereof is that no correction by means of a valve is required to, for example, decrease the speed of the carrier. Such correction requires letting the hydraulic oil that is pumped to the cylinder to return to the reservoir. This means that energy is lost. Through manipulation of the power supply to the motor, according to the invention, such correction means are not required and in principal all hydraulic oil used for lifting a load is in the descent mode returned through the pump and its energy is regenerated. In theory, all energy can be regenerated. In practice some conversion losses are present. However, experience has shown that the energy consumption by a system according to the invention is decreased significantly. The amount of this decrease depends on several parameters including the configuration of the system and the components used therein. As an example, for a given configuration the energy reduction was up to 25%. This leads to a more sustainable system. Furthermore, the use of the motor control means enable the provision of a speed control for setting the desired moving speed of the carrier with and without a load. This means that without any substantial additional components the speed can be selected and/or adapted by a user, for example depending on the load that is to be lifted by a lifting column. As an example, the speed of the carrier can be increased when lifting a passenger car and can be lowered when lifting a truck. With this control means especially the lifting operation can be performed smoothly, depending on the type of load. Also, by controlling the speed of the carriers the system is less sensitive for weight differences in the load resulting in different forces acting upon the different carriers. This improves the efficiency of the entire lifting operation. Preferably, the speed can be adjusted continuously, and more preferably this adjusting is done by the user with a button or switch. Additionally, the number of components that are used in the system is minimized as no additional correction valves are required. This minimizes costs, maintenance and improves reliability of the system. Furthermore, by using a controller a slow-start procedure can be implemented without requiring relatively complex and expensive hydraulic proportional measures.

In a preferred embodiment according to the present invention, the system further comprises at least a second lifting column and a system controller for synchronizing of the height of the carriers of the two or more lifting columns in the ascent and/or descent mode by directly or indirectly manipulating the power supply to a motor of at least one of the lifting columns.

When lifting a vehicle in most systems at least two lifting columns are being used. In fact, often four lifting columns are being used. During such lifting operation, the timing of these separate lifting columns and especially the moving speed of the carrier when lifting a vehicle, requires synchronization. The system controller synchronizes the height of the separate carriers in the ascent mode, using for example a measurement signal generated by a height sensor, for example a potential meter. Of course other sensors can also be used. In case one of the carriers has moved to fast in the ascent mode and is to high as compared to the other carriers of the other lifting columns the power supply to this carrier is either directly or indirectly lowered, so that the other carriers can catch up. In the descent mode it is also important that the height of the carriers between the several lifting columns is synchronized. Therefore, in case one of these carriers has moved to slowly its power supply is increased in order for this carrier to catch up with the other carriers. In addition to the above correction possibilities it is also possible to correct the other carriers. For example, in the ascent mode, in case of correcting the carriers that moved too fast, it is also possible to increase the power supply to the other carriers, so that their speed is also increased and they catch up with the fast moving carriers. Similarly, in the descent mode it is also possible to decrease the power supply to the other carriers in order to let the slowly moving carrier catch up with these carriers. Using the system controller, in combination with the motor control means according to the invention, improves the control possibilities for the system. This means that the lifting operation can be performed more smoothly as more possibilities for manipulation are available to the user of the system. In addition, the efficiently of the system is improved as, for example in the ascent mode, the slowest moving carrier is not necessarily holding up the entire operation.

In a preferred embodiment according to the present invention, the motor is a brushless motor.

Using brushless motors in the lifting system minimizes maintenance of the motor as the brushes are relatively sensitive to maintenance. In addition, the standstill periods of the system are minimized. Furthermore, the risk of defects is also minimized. This improves the reliability of the entire system. Furthermore through the use of brushless motors electrical resistances in the system are minimized, thereby improving the energy efficiency of the entire operation. This contributes to the sustainability of the system. Alternatively, instead of a brushless motor it is possible to use for instance a motor provided with an external filed control (separate excitation or SepEx).

In a preferred embodiment according to the present invention the lifting column is a mobile lifting column comprising at least one battery.

Through the use of batteries it is possible to provide lifting columns that are more sustainable. This means that a more flexible system is realized. The use of wireless communication means, like Bluetooth, Wi-Fi and Ultra-Wide Band, prevents the requirements of cables across the workshop. This improves safety for the users of the system. In addition, using batteries limits the peak capacity required from the electricity grid. Through combination of the mobile system with selection means it is also possible to increase the flexibility of the system even further. These selection means allow for selecting a lifting column of lifting columns into a group or subgroup, which could be as large as the entire group, but it usually smaller. The selected lifting columns are being used for lifting and lowering the object like a vehicle. This means that a lifting column can be selected when needed and in case a specific lifting column is not required by a user, to have this lifting column available for another user. This improves the efficiently of the entire lifting operation in the workshop.

By providing a solar panel to a lifting column it is possible to charge a battery of this lifting column. In application where this use of a solar panel is possible, this means that the batteries are being charged when used. This prevents charging the batteries using the electrical grid. This means that when using the solar panels, the availability of the lifting columns is improved as batteries can be charged when in use. Also, the required operation of coupling the lifting column or at least the battery thereof to the electrical grid is no longer required. Furthermore, the use of solar energy improves the overall sustainability of the entire system. Also, energy costs are minimized, thereby improving the overall efficiency of the system.

According to a preferred embodiment of the present invention, the motor control means comprises a convertor to convert direct current from the battery to alternating current for the motor.

By converting direct current to alternating current, motors using alternating currents can be used for the lifting columns in the system according to the invention. This enhances the use of brushless motors, minimizing maintenance of such motors. In addition, these AC motors enable the use of so-called soft start protocols, thereby reducing for example inrush currents and acceleration forces. This improves the mechanical reliability and battery life. Preferably, the direct current of the battery of 24V or alternatively 48V is transferred to 3×20V or 40V respectively.

In a further preferred embodiment according to the present invention the manipulation of the power supply to the motor (for correction of the height of a carrier) is in the range of 5-35%, preferably 5-25% and most preferably about 10%.

Through manipulation of the power supply in a range of 5-35% the position of the carrier can be corrected. In known systems large ranges for manipulation (for correction) are required due to accuracies of the values used and the changing of tpm under direct current with varying loads. According to the invention, in case the position of the carrier is higher than the desired position, the power supply is decreased. In case the carrier is below its desired position, power supply is increased. Through the use of the motor control means, the control of the lifting columns, and the carrier, therein can be performed more smoothly such that the bandwidth of the manipulation of the power supply is preferably between 5-25%. By timely adjusting the power supply, preferably by using feedback control and maintaining the selected tpm effectively, the control of the carrier position is improved. This not only minimizes shocks acting upon the vehicle that is lifted or lowered, it also improves control performance. By even further improving the timely adjustment of the value of the power supply, the manipulation preferably is about 10%. This further improves a smoothly operation, as compared to existing operation, wherein often more than one-third correction is required.

In a further preferred embodiment according to the present invention the pump is a hydraulic pump and the oil comprises a bio-degradable oil.

By using a bio-degradable oil the sustainability of the system is improved. Furthermore, handling of oil is made more easy. This improves the efficiency of the overall system. A possible bio-degradable oil is a full synthetic biodegradable oil, like for example PANOLIN HLP SYNTH. Preferably all oil used in the system is a biodegradable oil.

The invention further relates to a lifting column arranged to cooperate in a system as described above. Such a lifting column provides the same effects and advantages as those stated with reference to the system.

The invention furthermore relates to a method for controlling an energy efficient lifting and lowering a load, such as a vehicle, comprising the steps:

providing a system according to any of claims 1-8;

lifting and/or lowering a load;

controlling the lifting and/or lowering;

regenerate the potential energy, provided to the system in the ascent mode, in the descent mode.

Such method provides the same effects and advantages as those stated with reference to the system. Preferably the hydraulic fluid that is used by the system for lifting in the ascent mode is substantially entirely led back through the pump in the descent mode, thereby regenerating energy by using the motor as a generator. This leads to an energy efficient operation of the system according to the invention. Using this method and/or system improves the energy efficiency and availability of lifting columns.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION OF THE PREFERRED EMBODIMENTS

Figure 1:
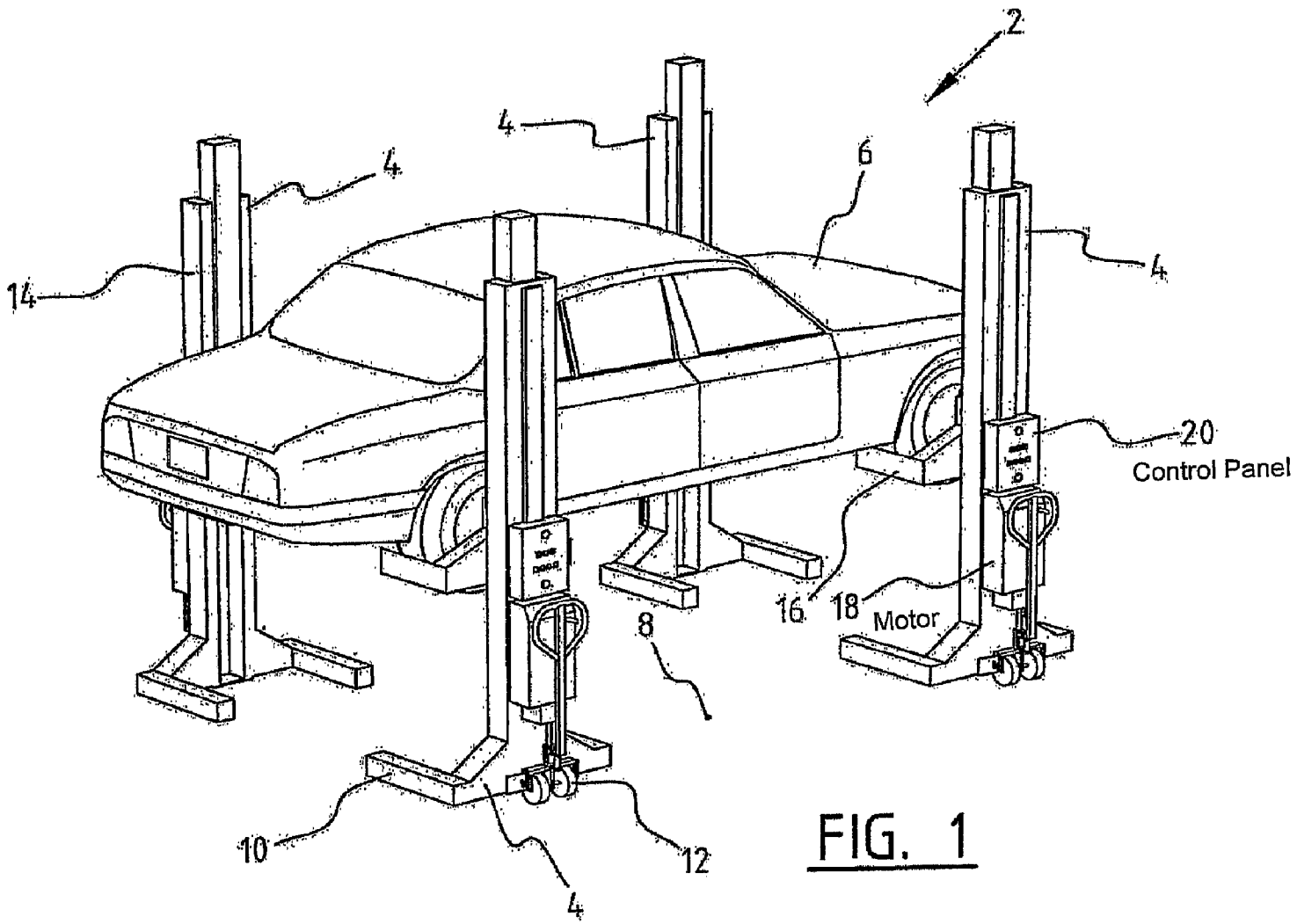
FIG. 1 shows a schematic overview of a vehicle lifted by lifting columns according to the invention.

A system 2 for energy efficient lifting and lowering a load (FIG. 1) comprises in the illustrated embodiment four mobile lifting columns 4. Lifting columns 4 lift a passenger car 6 from the ground 8. Lifting columns 4 are connected to each other and/or a control system by wireless communication means or cables. Lifting columns 4 comprise a foot 10 which can travel on running wheels 12 over ground surface 8 of for instance a floor of a garage or workshop. In the forks of foot 10 is provided an additional running wheel (not shown). Lifting column 4 furthermore comprises a mast 14. A carrier 16 is movable upward and downward along mast 14. Carrier 16 is driven by a motor 18 that is provided in a housing of lifting column 4. Motor 18 is supplied with power from the electrical grid or by a battery that is provided on lifting column 4 in the same housing as motor 18 or alternatively on foot 10 (not shown). Control panel 20 is provided to allow the user of system 2 to control the system, for example by setting the speed for the carrier 16.

Figure 2:
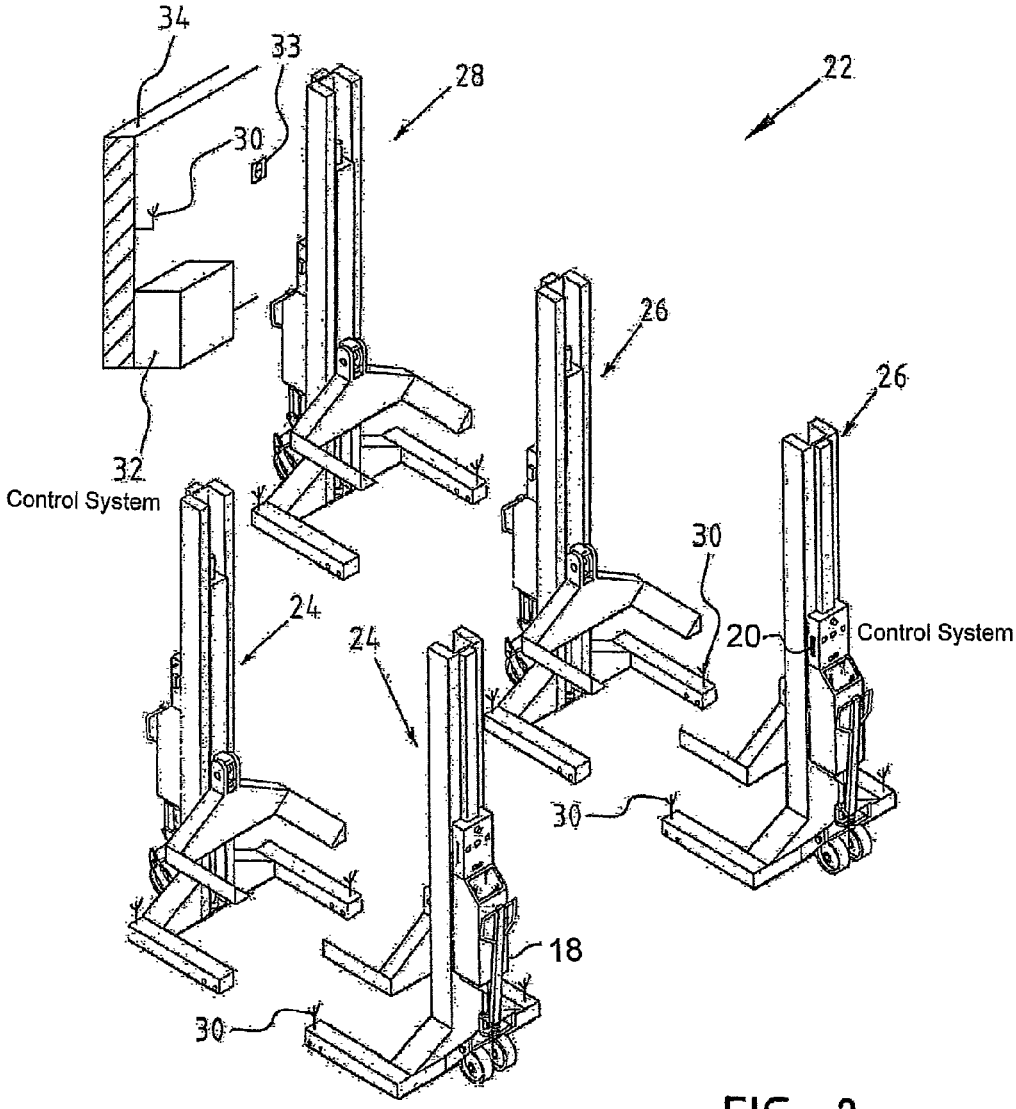
FIG. 2 shows a number of lifting columns according to the invention.

A system 22 (FIG. 2) comprises a number of lifting columns. System 22 comprises a first set of lifting columns 24 and a second set of lifting columns 26 that together form a group of lifting columns like system 2 that is illustrated in FIG. 1. Lifting columns 28 is not selected for this group and can be selected for a different group, lifting and lowering another vehicle. Lifting columns 24,26,28 are mobile lifting columns that communicate by sender/receiver 30 to each other and/or a central control system 32. A connection 33 to the electrical grid is provided on a sidewall 34 in the neighborhood of system 22. Sender/receiver 30 maybe used for determining the position of lifting columns 24,26 and 28.

Figure 3:
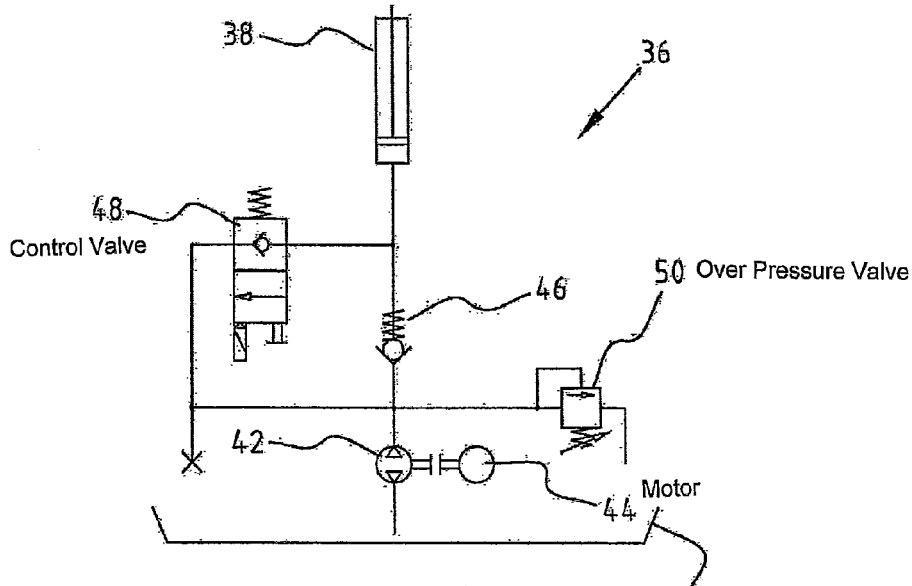
FIG. 3 shows a schematic overview of a hydraulic scheme according to the invention.

The hydraulic scheme 36 (FIG. 3) provides oil to cylinder 38 of a lifting column 4,24,26 and 28 in an ascent mode and removes the oil from cylinder 38 in the descent mode. In the ascent mode, oil is pumped from reservoir 40 by pump 42. Pump 42 is driven by motor 44. One-way valve 46 prevents oil returning from the cylinder 38 to reservoir 40. This lifts the load. In the descent mode oil is removed from cylinder 38 and flows through control valve 48 through pump 42 back to reservoir 40. The oil that is fed back through pump 42 drives motor 44 that operates as a generator to charge the batteries of the lifting columns. As a safety measure over-pressure valve 50 is provided to prevent damage to the hydraulic scheme 36.

Figure 4:
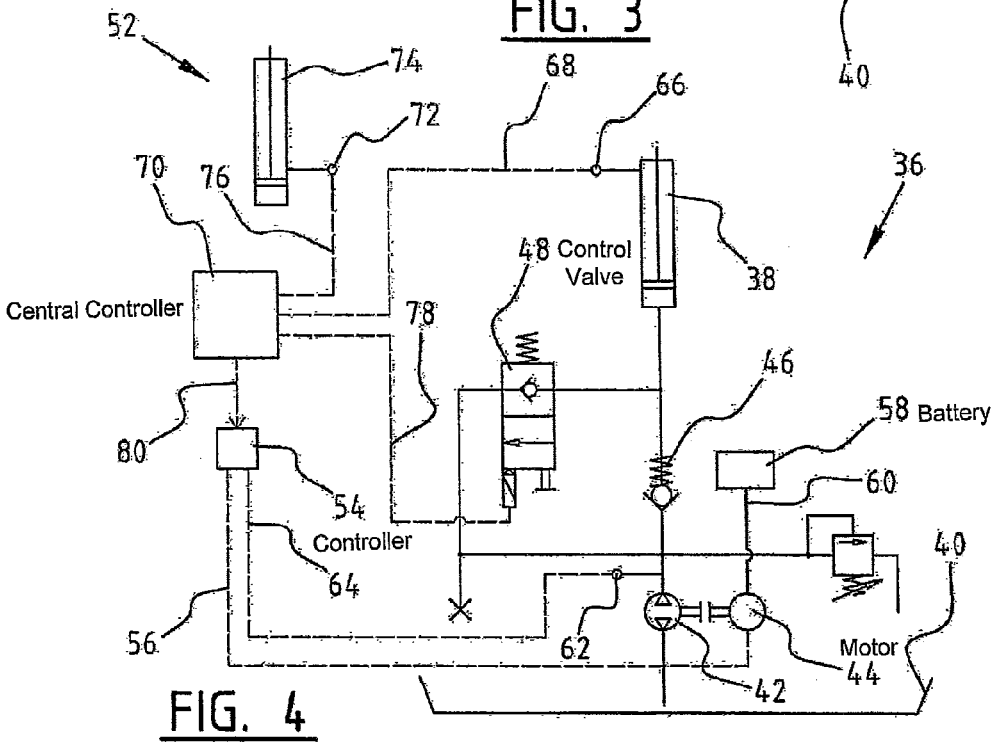
FIG. 4 shows schematically the control of a hydraulic scheme of FIG. 3.

Lifting system 2 is controlled by control scheme 52 (FIG. 4) that is also used to control the hydraulic scheme 36. Motor 44 is controlled by controller 54 that sends a control signal 56 to this motor 44. The power is supplied by batteries 58 by power supply line 60. In the descent mode, as the motor 44 generates energy, power is supplied from motor 44 to battery 58 for charging thereof. The number of revolutions by pump 42 and/or motor 44 is measured by sensor 62. The measurement is fed back to controller 54 by signal 64. Measurement signal 64 is used by controller 54 to control motor 44. To synchronize separate lifting columns 4 the height of carrier 16 is measured by sensor 66. This measurement is send by signal 68 to a central controller 70. Similar measurements come from similar sensors 72 on similar cylinders/lifting columns 74 and are provided by signals 76 to a central controller 70. Central controller 70 controls valve 48 that is activated in the descent mode, by control signal 78. To synchronize the separate lifting columns, especially with respect to the carriers 16 thereof, controller 70 sends a control signal 80 to the individual controller 54 of each lifting column 4. It will be understood that other configurations can be possible. For example the controllers 54, 70 can be integrated into one control system.

A lifting column 82 (FIG. 5) comprises a mast 84, guiding a carrier 86, and foot 88. Foot 88 is provided with wheels 90, 92 and a battery 94 provided on foot 88. This mobile lifting column 82 furthermore comprises a motor 96 that is provided in housing 98. Control system 100 enables a user to manipulate the settings of lifting column 82. Such a user can manipulate the setting for example the speed of carrier 86 during the ascent or descent mode, for example using a touch screen 102. Alternatively, it is also possible to use a switch. Mobile lifting column 82 can communicate with a central controller via sending/receiving means 104 Electrical components, like a controller 54, provided in housing 98 control also motor 96. Battery 94 provides power to motor 96 and also to these electrical components. Therefore, connections are made using cables 106 for charging battery 94. Lifting column 82 is provided with solar panel 108 that is connected to lifting column 82 by connecting rod 110. The generated power is send from solar panel 108 by cable 112 to battery 94.

Experiments for a specific configuration of the system have indicated that feeding all oil in the descent mode through the pump will generate an amount of potential energy that enables about 50-100% more lifting operations before for example charging a battery is required.

Figure 5:
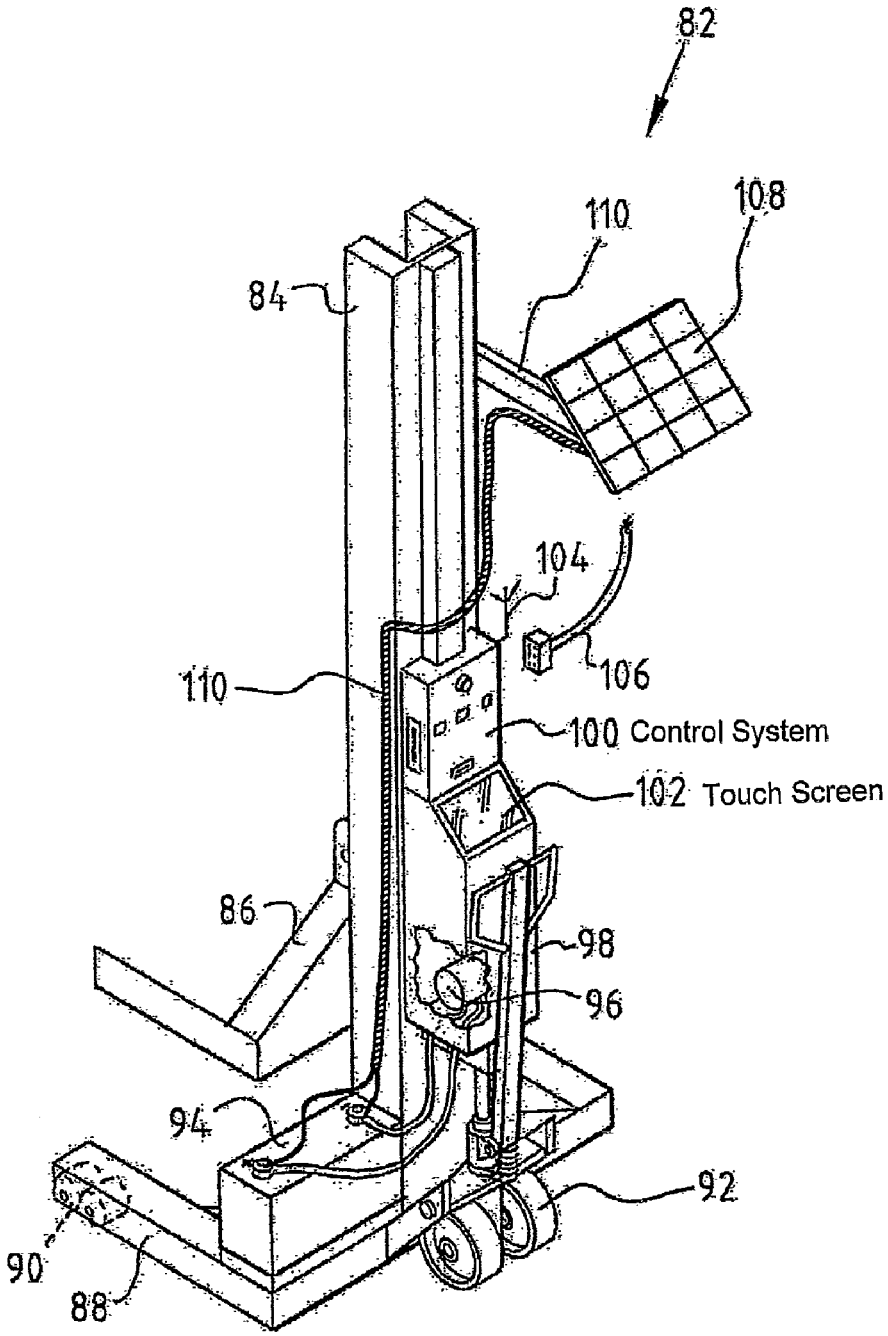
FIG. 5 shows a lifting column provided with a solar panel.

Therefore, by providing the motor control means implemented in hydraulic scheme 36 and control scheme 52, or alternatives thereof, the periods between charging of a mobile lifting column are extended. For example, for a given configuration, every about twenty lifting operations, the batteries need to be recharged. Using the system according to the invention only every thirty to forty lifting operations a recharge of the batteries is required at all. In case the lifting column 82 illustrated in FIG. 5 is used in the system according to the invention, it is even possible that recharging batteries by the electrical grid is no longer required. In that case a real stand-alone system is realized.

The present invention is by no means limited to the above described preferred embodiment. The rights sought are defined by the following claims within the scope of which many modifications can be envisaged. The present invention is described using a lifting column. According to the invention also so-called boom-lifts, scissor-lifts and loading platforms can be used as different types of lifting columns as the one illustrated above.

The invention claimed is:

1. A system for energy-efficient lifting and lowering a load, comprising:

a lifting column comprising a frame with a movable carrier and a drive which acts on the carrier, wherein the drive comprises a power source for power supply to a motor;

a pump in an ascent mode driven by the motor and in a descent mode driving the motor as a generator for generating electrical energy from potential energy during the lowering of the load; and motor control means for control of the motor, the motor control means arranged such that the power supply to the motor is manipulated for speed control of the carrier in at least the ascent mode.

2. The system according to claim 1, further comprising:

at least a second lifting column; and a system controller for synchronization of the height of the carriers on the two or more lifting columns in the ascent and/or descent mode, by directly or indirectly manipulating the power supply to a motor of at least one of the lifting columns.

3. The system according to claim 1, wherein the motor is a brushless motor.

4. The system according to claim 1, wherein the lifting column is a mobile lifting column comprising at least one battery.

5. The system according to claim 4, wherein the lifting column includes a solar panel for charging the at least one battery.

6. The system according to claim 4, wherein the motor control means comprises a convertor to convert direct current from the battery to alternating current for the motor.

7. The system according to claim 1, wherein the manipulation of the power supply to the motor is in the range of 5-35%.

8. The system according to claim 1, wherein the pump is a hydraulic pump and the oil comprises a biodegradable oil.

9. A lifting column, comprising:

a frame with a movable carrier and a drive which acts on the carrier, wherein the drive comprises a power source for power supply to a motor;

a pump in an ascent mode driven by the motor and in a descent mode driving the motor as a generator for generating electrical energy from potential energy during the lowering of a load; and motor control means for control of the motor, the motor control means arranged such that the power supply to the motor is manipulated for speed control of the carrier in at least an ascent mode.

10. A method for controlling energy-efficient lifting and lowering a load, comprising the steps of:

providing a system according to claim 1;

lifting and/or lowering a load;

controlling the lifting and/or lowering; and regenerating the potential energy, provided to the system in the ascent mode, in the descent mode.

11. The method according to claim 10, wherein the system uses an hydraulic fluid for lifting in the ascent mode and in the descent mode leads back substantially all fluid through the pump, thereby regenerating energy by using the motor as a generator.

12. The system according to claim 1, wherein the manipulation of the power supply to the motor is in the range of 5-25%.

13. The system according to claim 1, wherein the manipulation of the power supply to the motor is about 10%.

* * * * *

UNITED STATES PATENT AND TRADEMARK OFFICE

CERTIFICATE OF CORRECTION

PATENT NO. : 8,251,184 B2
APPLICATION NO. : 12/559880
DATED : August 28, 2012
INVENTOR(S) : Jurjen Jan De Jong It is certified that error appears in the above-identified patent and that said Letters Patent is hereby corrected as shown below:

Face of the Patent, Column 1, insert -- (30) Foreign Application Priority Data
Sept. 15, 2008 (NL) ..... 1035933 --

Signed and Sealed this
Thirteenth Day of November, 2012

David J. Kappos

David J. Kappos
*Director of the United States Patent and Trademark Office*